US008061322B2

(12) United States Patent
King et al.

(10) Patent No.: US 8,061,322 B2
(45) **Date of Patent: *Nov. 22, 2011**

(54) ENGINE STARTING SYSTEM WITH THROTTLE OVERRIDE

(75) Inventors: Eric L. King, Caro, MI (US); George M. Pattullo, Caro, MI (US); David L. Speirs, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 831 days.

This patent is subject to a terminal disclaimer.

(21) Appl. No.: 12/026,620

(22) Filed: Feb. 6, 2008

(65) Prior Publication Data

US 2008/0121201 A1 May 29, 2008

Related U.S. Application Data

(63) Continuation-in-part of application No. 11/414,423, filed on Apr. 28, 2006, now Pat. No. 7,334,551.

(51) Int. Cl.
*F02M 1/00* (2006.01)

(52) U.S. Cl. ..... 123/179.18; 123/185.3

(58) Field of Classification Search ..... 123/179.18, 123/185.3, 185.2, 185.4; 261/35, 52; 180/335
See application file for complete search history.

(56) References Cited

U.S. PATENT DOCUMENTS

| | | | | |
|---|---|---|---|---|
| 5,211,144 | A * | 5/1993 | Collins et al. | 123/198 E |
| 5,500,159 | A * | 3/1996 | Martinsson | 261/52 |
| 5,515,825 | A * | 5/1996 | Arai et al. | 123/406.74 |
| 5,634,442 | A * | 6/1997 | Weber | 123/179.8 |
| 5,927,241 | A | 7/1999 | Dahlberg et al. | |
| 6,848,405 | B1 * | 2/2005 | Dow et al. | 123/179.18 |
| 6,874,482 | B2 * | 4/2005 | Lahner et al. | 123/516 |
| 7,334,551 | B2 * | 2/2008 | Pattullo | 123/179.18 |
| 2005/0022790 | A1 * | 2/2005 | Nickel et al. | 123/438 |
| 2005/0166897 | A1 * | 8/2005 | Osburg et al. | 123/435 |
| 2006/0130809 | A1 * | 6/2006 | Wetor et al. | 123/376 |
| 2007/0056547 | A1 * | 3/2007 | Kruse et al. | 123/185.3 |

FOREIGN PATENT DOCUMENTS

| | | | |
|---|---|---|---|
| DE | 4016224 | A1 | 11/1991 |
| EP | 1640592 | A1 | 3/2006 |
| GB | 1051828 | | 12/1966 |
| JP | 03121267 | | 5/1991 |

* cited by examiner

*Primary Examiner* — Michael Cuff
*Assistant Examiner* — Long T Tran
(74) *Attorney, Agent, or Firm* — Reising Ethington P.C.

(57) ABSTRACT

A starting system for a combustion engine including a carburetor with a throttle valve moveable between idle and wide open positions, a throttle control to control movement of the throttle valve during normal operation of the engine, and a linkage between the throttle control and the throttle valve. The starting system includes a recoil pulley, a pull-cord to rotate the recoil pulley, an actuator moveable in response to rotation of the recoil pulley, and a throttle override device. The throttle override device has a first control member moveable from a first position to a second position in response to movement of the actuator, and a second control member moveable in response to movement of the first control member from a first to a second position. The second control member is operably associated with the linkage to prevent the throttle valve from being in its wide open position when the second control member is in its second position.

22 Claims, 4 Drawing Sheets

ENGINE STARTING SYSTEM WITH THROTTLE OVERRIDE

REFERENCE TO CO-PENDING APPLICATION

This application is a continuation-in-part of U.S. patent application Ser. No. 11/414,423, filed Apr. 28, 2006, and published as U.S. Patent Application Publication No. 20070251484 on Nov. 1, 2007, and issued as U.S. Pat. No. 7,334,551 on Feb. 26, 2008, the disclosure of which is incorporated herein by reference in its entirety.

FIELD OF THE INVENTION

The present invention relates generally to an engine starting system and more particularly to a starting system with a throttle override feature.

BACKGROUND OF THE INVENTION

For many decades small internal combustion engines, such as those used for recreational vehicles and landscaping tools like chain saws, trimmers, tractors, and lawn mowers, have typically used mechanical, manually-operated recoil pull-starters. In a direct recoil pull-starter, an operator of the vehicle or tool pulls a cord that is wound about a recoil pulley to rotate the recoil pulley in a first direction. The rotating recoil pulley rotates an engine crankshaft, via a one-way coupling, to start a combustion engine. When the cord is released by the operator, the recoil pulley automatically reverses rotation, by way of a recoil spring, to retract the cord back around the recoil pulley.

In the past, small engines were designed to start at wide open throttle (WOT), however, current small engines are designed to start at idle. Unfortunately, many end users are accustomed to starting an engine with the throttle valve in the WOT position and they try to do so even with an engine designed to start at idle. Retraining the end user to not open the throttle valve while attempting to start the engine is difficult.

SUMMARY OF THE INVENTION

A starting system is provided for a combustion engine including a carburetor with a throttle valve that is moveable between idle and wide open positions, a throttle control movable by an end user between a first position corresponding to the idle throttle valve position and a second position corresponding to the wide open throttle valve position to control movement of the throttle valve during normal operation of the engine, and a linkage between the throttle control and the throttle valve. The starting system includes a rotateable recoil pulley, a pull-cord wound about the recoil pulley to rotate the recoil pulley as the pull-cord is unwound from the recoil pulley, an actuator moveable in response to rotation of the recoil pulley, and a throttle override device. The throttle override device has a first control member moveable from a first position to a second position in response to movement of the actuator, and a second control member moveable from a first position to a second position in response to movement of the first control member to its second position. The second control member is operably associated with the linkage to prevent the throttle valve from being in its wide open position when the second control member is in its second position.

In one implementation, the linkage includes a Bowden cable that extends between the throttle control and the throttle valve of the carburetor, and is interlinked with the throttle override device. The throttle valve is yieldably biased to its idle position, such as by a return spring, so that when the Bowden cable is not providing a force tending to move or hold the throttle valve away from its idle position, the throttle valve automatically returns to its idle position. When the throttle override device is in its first position, the Bowden cable is maintained sufficiently taut so that actuation of the throttle control by the end user causes a corresponding movement of the throttle valve. However, when the throttle override device is moved to its second position, the effective distance between the throttle control and throttle valve is decreased. When this occurs, the same length of cable is then comparatively long which reduces the force transmitted in the cable and permits the throttle valve to return to its idle position under the force of the return spring. This prevents an end user from holding the throttle valve in its wide open position as the engine is started. In this manner, regardless of the end user's intent, the throttle valve is in its idle position as the engine is started.

In at least one embodiment, the movement of the throttle valve toward its idle position may take up the slack in the Bowden cable and the remaining tension in the Bowden cable may hold the throttle override device in its second position. An additional effective length can be reintroduced into the Bowden cable upon release of the throttle control back to its first position (corresponding to the idle position of the throttle valve) to reset the throttle control. In at least certain implementations, the throttle override device is yieldably biased to its first position, and upon return of the throttle control to its first position, the throttle override device returns to its first position. This make take up most, if not all, of the additional effective length in the Bowden cable so that the throttle valve is responsive to movement of the throttle control for normal throttle and engine operation after the engine has been started.

At least some of the objects, features and advantages that may be achieved by at least certain embodiments of the invention include providing an engine that starts reliably at idle, has a simplified start-up procedure that overrides a throttle control only during start-up, reduces or eliminates engine stalling on overly rich mixtures of fuel-and-air during engine startup, is of relatively compact construction, simple design, low cost when mass produced, rugged, durable, reliable, requires little to no maintenance and adjustment in use, and in service has a long useful life.

BRIEF DESCRIPTION OF THE DRAWINGS

The following detailed description of preferred implementations and best mode will be set forth with regard to the accompanying drawings, in which.

DETAILED DESCRIPTION OF PREFERRED EMBODIMENTS

Figures 1, 2:
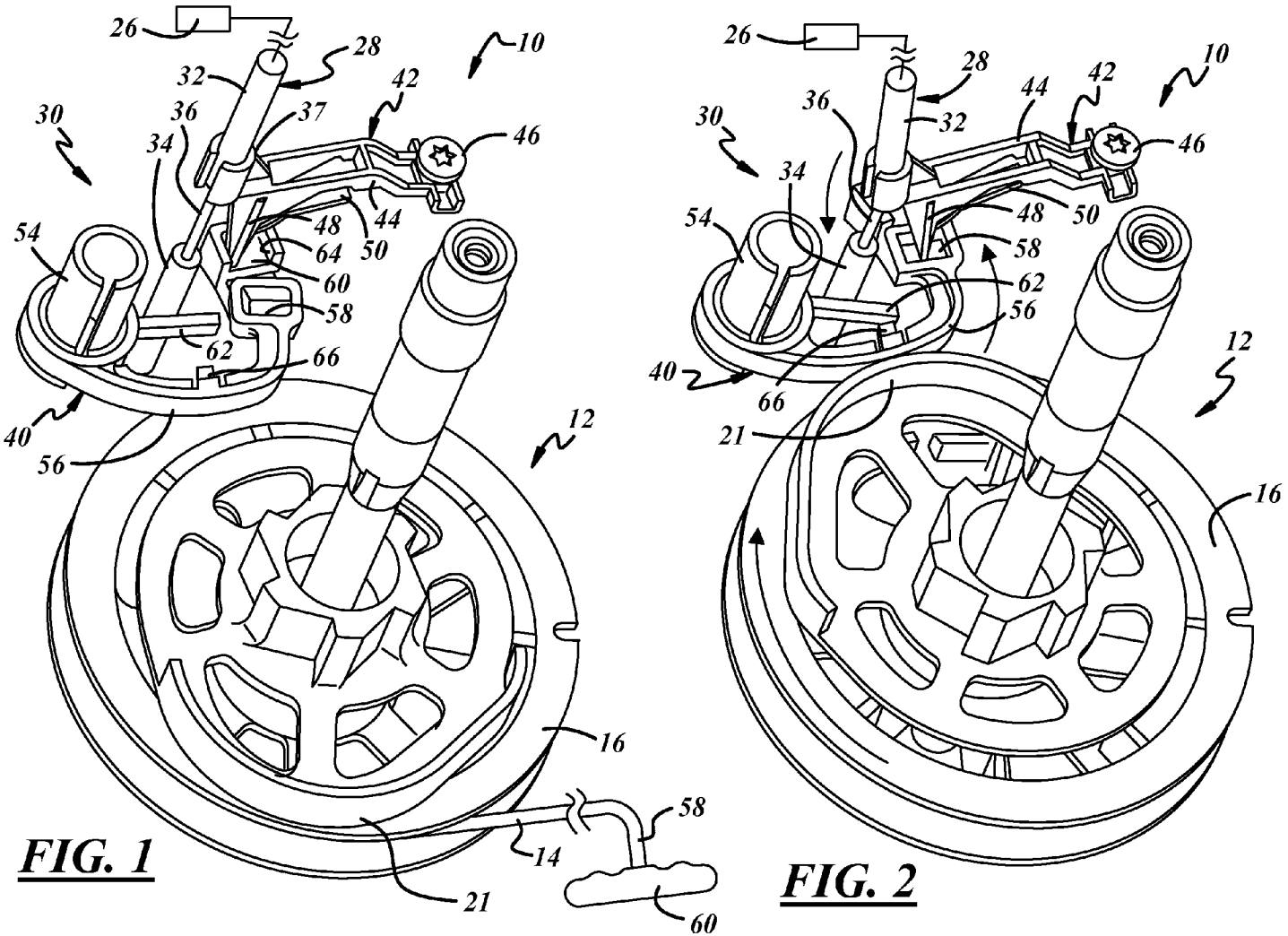
FIG. 1 is a perspective view of a portion of an engine starting system showing a recoil pulley and a throttle override device in its first position.
FIG. 2 is a perspective view of a portion of the engine starting system showing the throttle override device in its second position.
Figure 3:
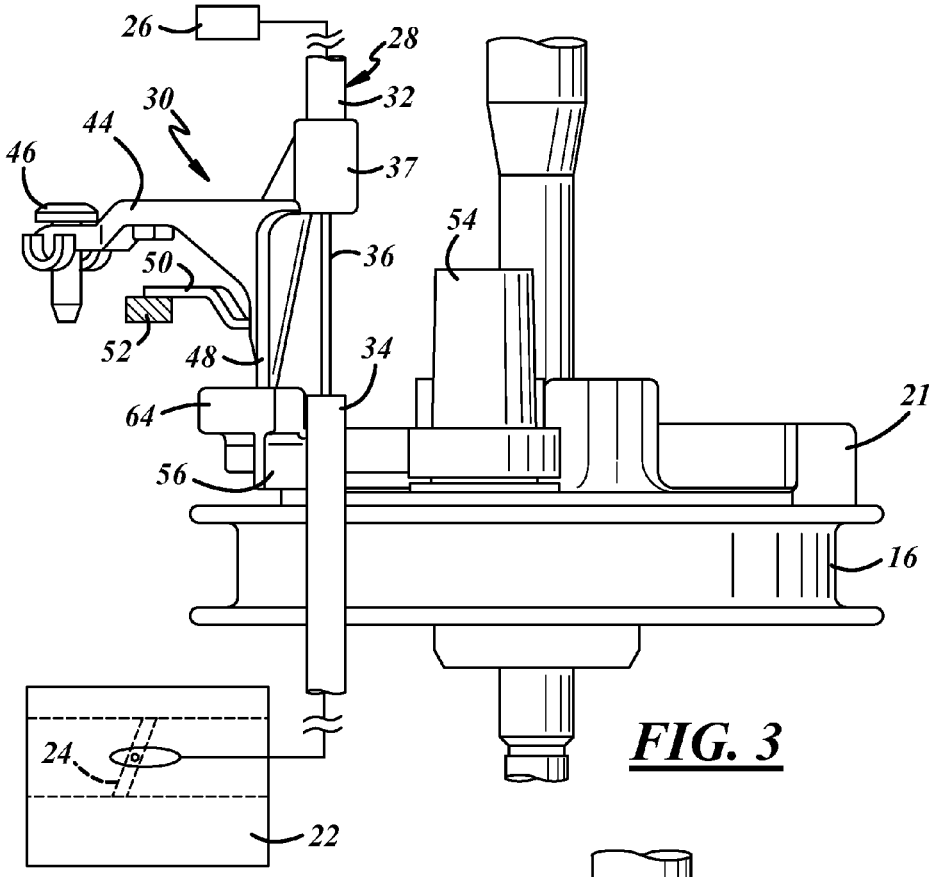
FIG. 3 is an end view of a portion of the engine starting system showing the throttle override device in its first position.
Figure 4:
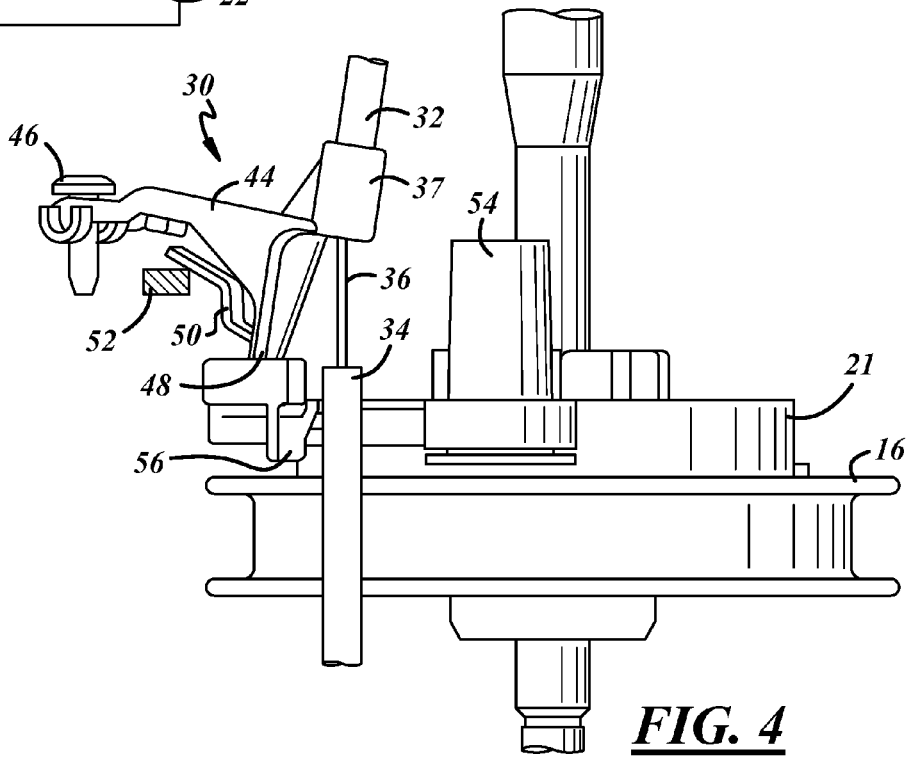
FIG. 4 is an end view of a portion of the engine starting system showing the throttle override device between its first and second positions.
Figure 5:
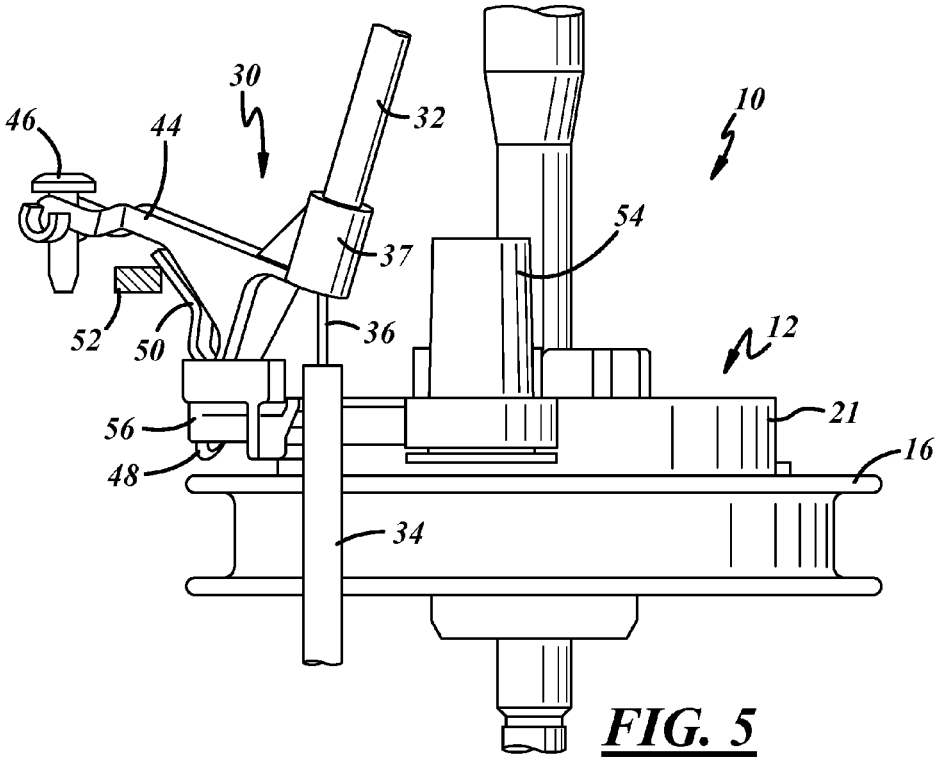
FIG. 5 is an end view of a portion of the engine starting system showing the throttle override device in its second position.

Referring in more detail to the drawings, FIGS. 1-5 illustrate a starting system 10 according to one implementation of the present invention, which may be utilized on internal combustion engines constructed and arranged to be started at or near engine idle speed. The starting system 10 includes a recoil pull-cord assembly 12 having a pull-cord 14 that when pulled by an operator against a rotational bias of a pulley 16 rotates a crankshaft of the engine to start the engine. The pulley 16 is preferably coupled to the crankshaft by a one-way clutch (not shown) that drives the crankshaft as the pull-cord 14 is pulled and permits the crankshaft to freely rotate relative to the pulley 16 when the engine is running. An actuator, such as a cam 21, may be carried for co-rotation with the pulley 16 as will be set forth in more detail later.

Preferably, one end of the pull-cord 14 is attached to the pulley 16 and extends, while wrapping around the pulley 16 in a counter-clockwise direction, to a free end 58 connected to a handle 60 (FIG. 1) accessible by an end user. When starting the engine, the end user manually grasps the handle 60 attached to the pull-cord 14 and pulls the pull-cord 14 which turns the pulley 16 in a counter-clockwise direction (as viewed in FIG. 2) against the bias of a return spring (not shown) that yieldably biases the pulley 16 in a direction tending to take up or wrap the pull-cord 14 around the pulley 16. As the pull-cord 14 is unwound from the recoil pulley 16, the recoil pulley 16 rotates the crankshaft of the engine causing the piston(s) to reciprocate with sufficient speed to start the engine. When the pull-cord 14 is released by the operator, the return spring causes the pulley 16 to rotate clockwise through one or more revolutions thereby wrapping the pull-cord 14 about the pulley 16 again.

The engine may be used for applications such as chainsaws, leaf blowers, and the like that typically receive a mixture of fuel and air from a carburetor 22 (FIG. 3) having a throttle valve 24 that moves between a substantially closed or idle position and a wide open throttle position. The tool or vehicle with which the engine is used includes a throttle control 26 that is operable to permit the end user to control movement of the throttle valve. The throttle control 26 may be moveable between first and second positions that correspond, respectively, to idle and wide open positions of the throttle valve in normal operation of the engine. The throttle control 26 may be linked to the throttle valve 24 by a linkage such as a Bowden cable 28. Because the engine may be designed to start at or near idle speed, a throttle override device 30 is provided between the throttle control 26 and the throttle valve 24 to prevent the throttle valve 24 from being maintained in its wide open position during starting of the engine.

The Bowden cable 28 preferably has a first sheath 32, a second sheath 34 spaced longitudinally or separated from the first sheath 32, and a flexible cable 36. The first sheath 32 is connected to an attachment feature or clip 37 of the throttle override device 30. The cable 36 is linked between the throttle valve 24 and the throttle control 26 so that actuation of the throttle control 26 causes the cable 36 to slide in the first and second sheaths 32, 34 and when there is no slack in the cable, movement of the throttle control 26 causes a corresponding movement of the throttle valve 24.

The throttle override device 30 interacts with and selectively reduces the tension in the Bowden cable to reduce the maximum force that can be transmitted through the cable 36 by movement of the throttle control 26. During starting of the engine, this can prevent the throttle valve 24 from being held in its wide open position as will be discussed in more detail below. In the implementation shown in FIGS. 1-5, the throttle override device 30 includes a first control member 40 moveable from a first position to a second position, and a second control member 42 moveable from a first position to a second position in response to movement of the first control member 40 to its second position.

The second control member 42 includes a tensioning arm 44 pivotally coupled by a fastener 46 to a housing, or other body, and including the clip 37 connected to the first sheath 32 of the Bowden cable 28 and a first finger or post 48 that may extend generally in the direction of the Bowden cable. A second finger 50 may interact with a stop surface 52 (FIGS. 3 and 4) to function as a return spring that yieldably biases the second control member 42 to its first position shown in FIG. 1. Movement of the second control member 42 to its second position, as shown in FIG. 2, bends the second finger 50 about the stop surface 52 providing a force tending to return the second control member 42 to its first position.

The first control member 40 includes a release arm 56 connected at one end to a shaft 54, and having a recess 58, a support surface 60 circumferentially spaced from the recess 58, and a biasing member such as a flexible cantilevered finger 62. The support surface 60 is positioned to engage the post 48 of the second control member 42 to prevent movement of the second control member 42 toward its second position when the support surface 60 is aligned with the post 48. To facilitate retaining the post 48 on the support surface 60, the support surface 60 may include an upstanding wall 64 surrounding the sides of the support surface except the side of the support surface leading to the recess 58.

As best shown in FIGS. 1 and 2, the first control member 40 is engaged and deflected by the cam 21 during at least a portion of the rotation of the recoil pulley 16 during an attempt to start the engine. The movement, deflection or bending of the first control member 40 rotates or pivots the arm 44 from its first position, shown in FIG. 1, with the support surface 60 aligned with the post 48, to its second position shown in FIG. 2 with the recess 58 aligned with the post 48. When the recess 58 is aligned with the post 48, the post 48 drops into the recess 58 at least when the Bowden cable 28 is under sufficient tension. The Bowden cable 28 will be under sufficient tension when the throttle control 26 is actuated to move and hold the throttle valve 24 away from its idle position. The movement of the first control member 40 can also increase the force of or load-up a spring or other biasing member. In the implementation shown, this is accomplished by deflecting the finger 62 about the Bowden cable 28 or some other surface to store energy in the finger 62, which energy helps return the first control member 40 to its first position when the post 48 clears the recess 58 upon resetting of the throttle override device 30. A stop 66 carried by the first control member 40 may engage the finger 62 to limit the maximum deflection of the first control member 40 and thereby prevent damage to the arm 56 and finger 62 of the first control member 40.

During starting of the engine, the pull-cord 14 is pulled by the end user which unwinds the pull-cord from the pulley 16, and rotates the pulley. When the cam 21 is rotated into alignment with the first control member 40, the cam 21 engages and deflects the first control member 40 as shown in FIG. 2. This movement of at least part of the first control member 40 moves the support surface 60 away from and aligns the recess 58 with the post 48 of the second control member 42. If the end user has actuated the throttle control 26 to move the throttle valve 24 toward its wide open position prior to pulling the pull-cord 14, the Bowden cable 28 will be under tension and the post 48 of the second control member 42 will move from its first position (FIG. 1) and into the recess 58 to its second position (FIG. 2). This movement of the second control member 42 brings the first and second sheaths 32, 34 closer together and lessens the tension on the cable 36 so that the force of the throttle valve return spring is greater than the maximum force that can be exerted on the throttle valve 24 by the cable 36 when the second control member 42 is in its second position. Accordingly, the throttle valve 24 moves back to its idle position under the force of its return spring. The second control member 42 remains in its second position so long as the throttle control 26 is actuated or maintained sufficiently away from its first position. In its second position, the second control member 42 holds the first control member 40 in its second position (by way of engagement of the post 48 with the arm 56 within the recess 58) and subsequent revolutions of the cam 21 do not affect the relative positions of the first and second control members of the throttle override device 30. In this manner, if the end user opened the throttle valve 24 before attempting to start the engine (by moving the throttle control to its second position), the throttle valve 24 will be moved back to its idle position before the engine is started even if the user maintains the throttle control 26 in its second position, so that the engine can be predictably and reliably started with the throttle valve in its idle position, or at some other desired starting position.

To reset the throttle override device 30 and permit end user control of the throttle valve 24, the end user releases the throttle control 26 which further reduces or eliminates the tension in the Bowden cable 28 such that the second control member 42 can move back to its first position under the force provided by its second finger 50. This removes the post 48 from the recess 58 and permits the biasing member 62 of the first control member 40 to return the first control member 40 back to its first position with the support surface 60 aligned with the post 48. Thereafter, movement of the second control member 42 is resisted by engagement of the post 48 with the support surface 60 so that the force provided by end user movement of the throttle control 26 is transmitted directly to the throttle valve 24 without significant loss of force through the throttle override device 30. In other words, the throttle override device 30 is inactive and the end user can command the desired position of the throttle valve 24.

Figure 6:
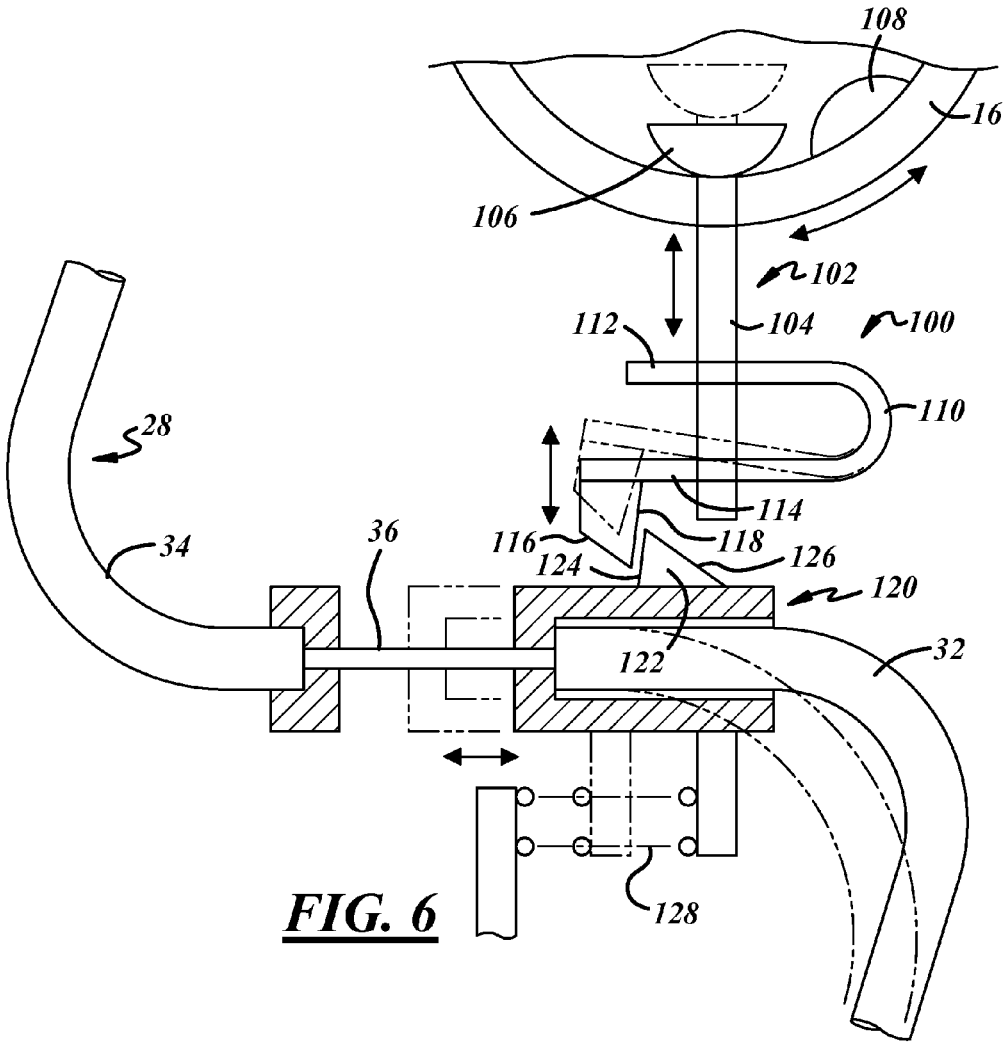
FIG. 6 is a diagrammatic and partially in-section side view of a portion of a starting system showing an alternate throttle override device.

A modified version of a throttle override device 100 is illustrated in FIG. 6. In this implementation, a first control member 102 includes a stem 104 and a follower 106 carried by the stem 104 so that the follower 106 is capable of being engaged by an actuator or cam 108 carried by the recoil pulley 16. The first control member 102 may also include a biasing member 110 that yieldably biases the first control member 102 to its first position. The biasing member 110 may be connected to the first control member 102, such as at the stem 104, so that the biasing member is responsive to movement of the first control member. In the implementation shown, the biasing member 110 may be a generally U-shaped body with a first leg 112 fixed against movement and a second leg 114 connected to the stem 104 and capable of being deflected or bent relative to the first leg 112. The second leg 114 includes a ramp 116 and a stop surface 118 adapted to engage a second control member 120 carried by or operably associated with the first sheath 32 of the Bowden cable 28 to selectively prevent movement of the first sheath 32 relative to the second sheath 34. The biasing member 110 preferably is formed from a resilient material and is moved only within its range of elastic deformation so that the second leg 114 will resiliently return to its undeflected state when the force deflecting the leg is removed. In this manner, the second leg 114 can be considered to be yieldably biased to its undeflected or first position. The biasing member 110 could also be partially or entirely moveable (e.g. slideable or rotateable) rather than merely having a deflectable portion, and could include a return spring or other biasing member or any other arrangement or mechanism to return it to its first position when so moved.

In one implementation, the Bowden cable 28 may be constructed as previously described to include separated first and second sheaths 32, 34 and an inner cable 36. The second sheath 34 may be fixed against movement. The first sheath 32 may be moveable relative to the second sheath 34 and may be associated with the second control member 120 which includes or carries a cam 122 with a stop surface 124 and a ramp 126. A return spring 128 may act on the second control member 120 to yieldably bias it and the first sheath 32 to their first position shown in solid lines in FIG. 6.

In use, prior to starting an engine, the first control member 102, second control member 120 and first sheath 32 of the Bowden cable 28 are all in their respective first positions as shown in solid lines. If the end user manipulates the throttle control to command the throttle valve to its wide open position, the stop surface 118 of the second leg 114 engages the cam stop surface 124 to prevent movement of the first sheath 32 toward the second sheath 34. In this manner, the throttle control command is directly communicated with the throttle valve which is moved to its wide open position.

When the pull-cord 14 is pulled and the recoil pulley 16 is rotated to start the engine, the cam 108 engages the follower 106 and displaces the first control member 102 from its first position (shown in solid lines in FIG. 6) to its second position (shown in phantom in FIG. 6). This movement of the first control member 120 flexes or moves the second leg 114 of the biasing member to its second position (as shown in phantom lines in FIG. 6) and disengages the stop surface 118 from the cam stop surface 124 of the second control member 120. Because the end user has manipulated and is holding the throttle control in the position corresponding to the wide open throttle valve position, there is sufficient tension in the cable 36 to cause the second control member 120 and first sheath 32 to move toward the second sheath 34 and to their second position shown in broken lines. This movement of the first sheath 32 reduces the distance between the sheaths 32, 34 and reduces the tension in the cable 36 sufficiently so that the throttle valve returns to its idle position under the force of its return spring. The remaining tension in the cable 36 and the force of the throttle valve return spring hold the first sheath 32 in its second position (shown in phantom in FIG. 6) against the force of the return spring, to maintain the throttle valve in its idle position as the engine is started.

After the recoil pulley cam 108 passes the follower 106 of the first control member 102, the first control member 102 returns to its first position as the second leg 114 of the biasing member 110 resiliently returns to its first position. In this position of the throttle override device 100 and the first sheath 32, the ramp 116 and the cam ramp 126 are disposed adjacent one another and generally aligned. This facilitates the return movement of the second control member 120 and first sheath 32 of the Bowden cable back to their first position when the end user releases the throttle control back to its position that normally (i.e. without intervention of the throttle override device) corresponds to an idle position of the throttle valve. When the end user releases the throttle control, the tension in the Bowden cable 28 is reduced sufficiently so that the return spring 128 moves the second control member 120 and first sheath 32 back to their first position wherein along the way the cam ramp 126 slidably engages the opposed ramp 116 and displaces the second leg 114 until the cam 122 passes the ramp 116. The throttle override device 100 and Bowden cable 28 are now reset to their first positions. Accordingly, subsequent actuation of the throttle control increases the tension or force on the Bowden cable 28 but movement of the first sheath 32 is prevented by engagement of the stop surface 118 with the cam stop surface 124. Accordingly, the effective distance between the throttle control and throttle valve is increased so the Bowden cable 28 is comparatively shorter and under greater tension so that the full force of the throttle control movement can be transmitted to the throttle valve to move the throttle valve toward its wide open position. In other words, with the throttle override device 100 and Bowden cable 28 reset to their first positions, the throttle control and throttle valve function as they would if no throttle override device were provided at all.

Figure 7:
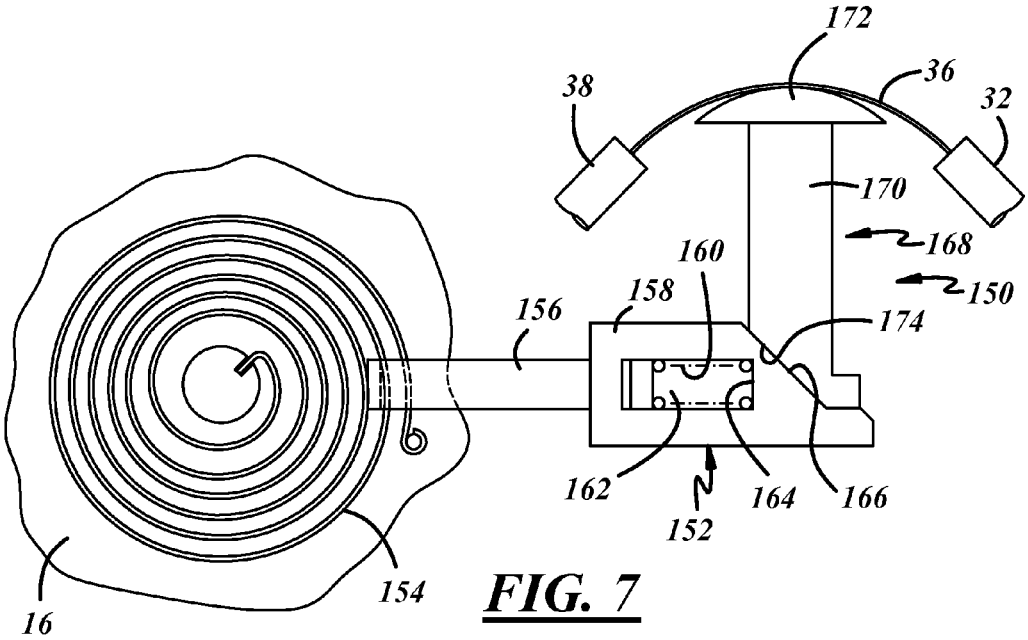
FIG. 7 is a diagrammatic view of a portion of a starting system with another alternate throttle override device shown in its first position.
Figure 8:
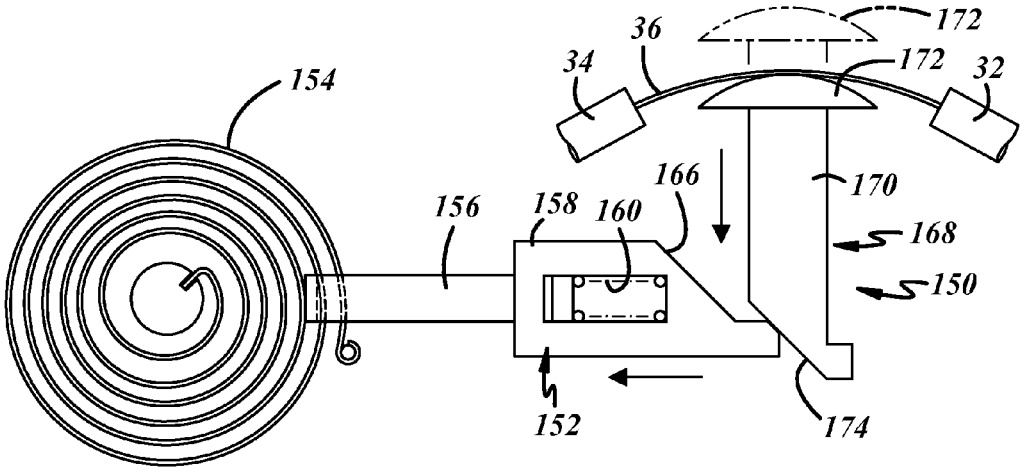
FIG. 8 is a diagrammmatic view of the throttle override device of FIG. 7 showing the throttle override device in its second position.

FIGS. 7 and 8 illustrate another implementation of a throttle override device 150. In this throttle override device 150, a first control member 152 is operably associated with a recoil spring 154 of the recoil pulley 16 so that the first control member 152 is responsive to loading of the recoil spring 154 during rotation of the recoil pulley 16 associated with starting the engine. Accordingly, in this implementation, the recoil spring 154 constitutes an actuator that causes movement of the throttle override device 150. The first control member 152 includes a stem 156 and a head 158 connected to the stem 156 for movement relative to the stem. A biasing member, such as a spring 160, yieldably biases the head 158 in a direction tending to remove the head 158 from the stem 156. In one implementation, an end of the stem 156 is received in a blind bore 162 formed in the head 158 and the spring 160 is disposed in the bore 162 between an end wall 164 of the bore 162 and the stem 156. A suitable connection is provided between the stem 156 and the head 158 to prevent them from separating. The head 158 includes a ramp 166 that is engageable with a second control member 168 of the throttle override device 150.

The second control member 168 includes a body 170, a head 172 carried by the body 170, and a ramp 174. The head 172 is adapted to be engaged by a portion of a Bowden cable 28, and is shown as being engaged by the inner cable 36. The body 170 extends from the head 172 to the ramp 174. The ramp 174 may have a complementary slope and be adapted to selectively engage the ramp 166 of the first control member 152.

In use, prior to starting an engine, the first control member 152, second control member 168 and the recoil spring 154 are all in their respective first positions as shown in FIG. 7. If the end user manipulates the throttle control to command the throttle valve to its wide open position, the force that the Bowden cable 28 exerts on the first control member 152 increases but is insufficient to move the first control member 152 against the opposing forces acting thereon, including the frictional engagement of the ramps 166, 174, the force of the return spring 160 and the force of the recoil spring 154. In this manner, the throttle control command is directly communicated with the throttle valve which is moved to its wide open position.

When the recoil pulley 16 is rotated to start the engine, the recoil spring 154 moves as it becomes loaded and this movement causes the first control member 152 to move from its first position to its second position as shown in FIG. 8. In the embodiment shown, the recoil spring 154 is a torsional spring that tightens or reduces in diameter as the recoil pulley 16 rotates. In any event, as the first control member 152 moves to its second position, the force exerted on the second control member 168 by the Bowden cable 28 displaces the second control member 168 to its second position, also shown in FIG. 8. This movement of the second control member 168 shortens the effective distance between the throttle control and the throttle valve which reduces the force or tension in the Bowden cable 28. With the force in the Bowden cable 28 reduced sufficiently, the throttle valve returns to its idle position under the force of its return spring. The remaining tension or force in the Bowden cable 28 and the force of the throttle valve return spring hold the second control member 168 in its second position against the force of the return spring 160 and the recoil spring 154, to maintain the throttle valve in its idle position as the engine is started.

When the end user releases the throttle control, the tension in the Bowden cable 28 is eliminated or reduced sufficiently so that the return spring 160 and recoil spring 154 move the first control member 152 back to its first position wherein along the way its ramp 166 slidably engages the opposed ramp 174 of the second control member 168 and returns the second control member 168 back to its first position. The throttle override device 150 and Bowden cable 28 are now reset to their first positions. Accordingly, subsequent actuation of the throttle control increases the tension or force on the Bowden cable 28 but movement of the second control member 168 is prevented by the frictional and spring forces acting thereon. Accordingly, the full force applied to the Bowden cable 28 by the throttle control can be transmitted to the throttle valve to move the throttle valve toward its wide open position as commanded by the end user. In other words, with the throttle override device 150 and Bowden cable 28 reset to their first positions, the throttle control and throttle valve function as they would if no throttle override device were provided at all.

The descriptions of all of the above-described embodiments and modified forms are incorporated by reference into one another. While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit or scope of the invention as defined by the following claims.

The invention claimed is:

1. A starting system for a combustion engine including a carburetor with a throttle valve that is movable between idle and wide open positions, and a throttle control movable by an end user between a first position corresponding to the idle throttle valve position and a second position corresponding to the wide open throttle valve position to control movement of the throttle valve during normal operation of the engine, the starting system comprising:

a rotatable recoil pulley;

a pull-cord constructed and arranged to wind about the recoil pulley and to rotate the recoil pulley as the pull-cord is unwound from the recoil pulley;

an actuator movable in response to rotation of the recoil pulley;

a linkage between the throttle control and the throttle valve; and a throttle override device having a first control member movable from a first position to a second position in response to movement of the actuator, and a second control member movable from a first position to a second position in response to movement of the first control member to its second position, wherein the second control member is operably associated with the linkage to prevent the throttle valve from being in its wide open position when the second control member is in its second position and the throttle control is in its second position.

2. The starting system of claim 1 wherein the actuator includes a cam and the first control member includes a follower engaged by the cam when the recoil pulley is rotated.

3. The starting system of claim 1 wherein the linkage includes a cable having separate first and second cable portions with the second cable portion operably associated with the second control member such that movement of the second control member to its second position reduces the force that can be exerted on the throttle valve through the cable by movement of the throttle control to permit the throttle valve to move to its idle position even if the throttle control is in its second position.

4. The starting system of claim 3 wherein the throttle valve is yieldably biased to its idle position and the maximum force exerted on the throttle valve by the cable when the second control member is in its second position is less than the force biasing the throttle valve to its idle position.

5. The starting system of claim 3 which also includes a biasing member associated with the second control member to yieldably bias the second control member to its first position and wherein the cable force on the second control member exceeds the force of the biasing member on the second control member when the throttle control is moved to its position associated with the wide open position of the throttle valve.

6. The starting system of claim 5 wherein when the throttle control is moved to its position associated with the idle position of the throttle valve, the cable force on the second control member is less than the force of the biasing member on the second control member so that the second control member returns to its first position.

7. The starting system of claim 2 wherein the first control member is moved from its first position to its second position when the cam engages the follower, the second control member is thereby moved to its second position and the second control member engages the first control member to prevent the first control member from returning to its first position when a sufficient force is provided from the linkage on the second control member.

8. The starting system of claim 7 wherein the linkage exerts a force on the second control member sufficient to prevent the first control member from moving to its first position when the throttle control is maintained in its second position after the first control member has moved to its second position.

9. The starting system of claim 7 wherein the second control member is received in a recess in the first control member to prevent the first control member from returning to its first position.

10. The starting system of claim 7 wherein the second control member is disposed in the path of travel of an end of the first control member to prevent the first control member from returning to its first position.

11. The starting system of claim 1 wherein the first control member engages the second control member when the first and second control members are in their first position to prevent the second control member from moving to its second position so that movement of the throttle control causes a corresponding movement of the throttle valve.

12. The starting system of claim 11 wherein the actuator includes a cam, the first control member includes a follower engaged by the cam when the recoil pulley is rotated, and the first control member includes a stop that engages the second control member when the first and second control members are in their first positions and when the cam engages the follower the first control member is moved to its second position wherein the stop is moved away from the second control member and the second control member moves to its second position when the force exerted by the linkage on the second control member is sufficient to move the linkage to its second position.

13. The starting system of claim 12 which also comprises a biasing member operably associated with the second control member to yieldably bias the second control member to its first position and wherein the force exerted by the linkage on the second control member must overcome the force on the second control member exerted by the biasing member to move the second control member to its second position.

14. A starting system for a combustion engine, comprising:

a carburetor with a throttle valve that is movable between idle and wide open positions, a throttle control movable by an end user between a first position corresponding to the idle throttle valve position and a second position corresponding to the wide open throttle valve position at least during normal operation of the engine, a cable connecting the throttle control and the throttle valve, the cable including separate first and second cable portions;

a rotatable recoil pulley;

a pull-cord constructed and arranged to wind about the recoil pulley and to rotate the recoil pulley as the pull-cord is unwound from the recoil pulley;

an actuator movable in response to rotation of the recoil pulley; and a throttle override device having a first control member movable from a first position to a second position in response to movement of the actuator, and a second control member movable from a first position to a second position in response to movement of the first control member to its second position, wherein the second control member is operably associated with the second cable portion to reduce an actuating force transmitted through the cable and prevent the throttle valve from being in its wide open position when the second control member is in its second position.

15. The starting system of claim 14 wherein the actuator includes a cam and the first control member includes a follower engaged by the cam when the recoil pulley is rotated so that the first control member is moved from its first position to its second position when the recoil pulley is rotated.

16. The starting system of claim 15 wherein movement of the second control member moves the second cable portion toward the first cable portion to limit the force applied from the throttle control to the throttle valve.

17. The starting system of claim 16 wherein the second cable portion is connected to the second control member, the second control member when in its first position bears on the first control member when the first control member is in its first position, and when the first control member is moved by the actuator, the second control member moves to its second position.

18. The starting system of claim 17 wherein the first control member includes a support surface engaged by the second control member when the first and second control members are in their respective first positions and a recess aligned with the second control member when the first control member is in its second position, and wherein the second control member is received at least partially in the recess when the second control member is in its second position.

19. The starting system of claim 17 wherein the first control member includes a stop that engages a mating stop of the second control member when the first and second control members are in their respective first positions, and wherein the stop of the first control member is moved when the first control member moves to its second position so that the second control member can move to its second position.

20. The starting system of claim 14 wherein the cable provides a force on the second control member to hold the second control member in its second position at least when the throttle control is in its second position.

21. The starting system of claim 20 which also includes a biasing member that yieldably biases the second control member to its first position and when the throttle control is in its first position, the force the cable provides on the second control member is less than the force of the biasing member so that the second control member returns to its first position.

22. The starting system of claim 14 wherein the actuator includes a spring operably associated with the recoil pulley and the first control member to apply a force to the first control member when the recoil pulley is rotated so that the first control member is moved from its first position to its second position.

* * * * *